US007784302B2

(12) United States Patent
Jung et al.

(10) Patent No.: US 7,784,302 B2
(45) Date of Patent: Aug. 31, 2010

(54) SOLDERED REFRIGERANT CONDENSER

(75) Inventors: Patrick Jung, Roth (FR); Sylvain Louis, Metz (FR); Alain Maurer, Weislingen (FR); Christian Michels, Kaskatel (FR); Gerrit Wölk, Stuttgart (DE)

(73) Assignees: Behr France Hambach S.A.R.L., Hambach (FR); Behr GmbH & Co. KG, Stuttgart (DE)

( * ) Notice: Subject to any disclaimer, the term of this patent is extended or adjusted under 35 U.S.C. 154(b) by 1238 days.

(21) Appl. No.: 10/508,921

(22) PCT Filed: Mar. 14, 2003
(Under 37 CFR 1.47)

(86) PCT No.: PCT/EP03/02662

§ 371 (c)(1),
(2), (4) Date: Feb. 9, 2006

(87) PCT Pub. No.: WO03/081146

PCT Pub. Date: Oct. 2, 2003

(65) Prior Publication Data

US 2008/0047297 A1 Feb. 28, 2008

(30) Foreign Application Priority Data

Mar. 25, 2002 (DE) ..... 102 13 194

(51) Int. Cl.
*F25B 43/00* (2006.01)

(52) U.S. Cl. ..... 62/474; 62/513

(58) Field of Classification Search ..... 62/509, 62/513, 474

See application file for complete search history.

(56) References Cited

U.S. PATENT DOCUMENTS

| | | | | |
|---|---|---|---|---|
| 4,707,999 | A | 11/1987 | Ohta et al. | |
| 5,088,294 | A * | 2/1992 | Ando | 62/119 |
| 5,159,821 | A | 11/1992 | Nakamura | |
| 5,419,141 | A | 5/1995 | Burk | |
| 5,435,153 | A * | 7/1995 | Hutchison et al. | 62/474 |
| 5,537,839 | A | 7/1996 | Burk et al. | |
| 5,666,791 | A * | 9/1997 | Burk | 62/474 |
| 5,992,174 | A | 11/1999 | Mittelstrass | |
| 6,330,810 | B1 | 12/2001 | Yamazaki et al. | |
| 6,446,714 | B1 | 9/2002 | Kaspar et al. | |
| 6,477,858 | B2 | 11/2002 | Nobuta et al. | |
| 7,121,114 | B2 * | 10/2006 | Forster et al. | 62/509 |

FOREIGN PATENT DOCUMENTS

| | | | |
|---|---|---|---|
| DE | 42 38 853 | A1 | 5/1994 |
| DE | 43 19 293 | A1 | 12/1994 |
| DE | 199 26 990 | A1 | 12/1999 |

(Continued)

*Primary Examiner*—Melvin Jones
(74) *Attorney, Agent, or Firm*—Foley & Lardner LLP

(57) ABSTRACT

The invention relates to a soldered refrigerant condenser that consists of a heat exchange network with flat pipes and corrugated ribs, of collector pipes that fluidically communicate with the flat pipes, and of a collector (10) that is arranged in parallel to one of the collector pipes. Said collector accommodates a dryer and/or a filter (31) and fluidically communicates with the collector pipe via two overflow openings (13, 14). The dryer is configured by a chamber containing a drying agent (28) and limited by a section (18) of the collector (10, 11) and two endplates (23, 24) that extend through the cross-section of the collector (10, 11).

12 Claims, 3 Drawing Sheets

FOREIGN PATENT DOCUMENTS

| | | | |
|---|---|---|---|
| DE | 198 48 744 | A1 | 4/2000 |
| DE | 101 55 861 | A1 | 7/2002 |
| DE | 101 19 743 | A1 | 10/2002 |
| EP | 0 689 041 | A1 | 12/1995 |
| EP | 0 668 986 | B1 | 6/1997 |
| EP | 0 867 670 | A2 | 9/1998 |
| EP | 0 704 662 | B1 | 3/2000 |
| EP | 1 079 186 | A1 | 2/2001 |
| EP | 1 147 930 | B1 | 12/2001 |
| EP | 0 669 506 | B2 | 11/2003 |
| FR | 2 750 761 | A1 | 1/1998 |
| JP | 2001-141332 | A | 5/2001 |
| JP | 2001-263869 | A | 9/2001 |
| JP | 2001-343175 | A | 12/2001 |

* cited by examiner

SOLDERED REFRIGERANT CONDENSER

The invention relates to a soldered refrigerant condenser which consists of a heat exchanger network with flat tubes and corrugated ribs, of collecting tubes which are fluid-connected to the flat tubes and of a header which is arranged parallel to one of the connecting tubes and which receives within it a dryer and/or a filter and is fluid-connected to the collecting tube via two overflow orifices, a condenser of this type being known from the Applicant's EP 0 669 506 A1.

This known condenser is what is known as a condenser module, in which is arranged, parallel to one of the collecting tubes, a header which is fluid-connected to the collecting tube via two overflow orifices. The refrigerant can thereby flow out of the collecting tube into the header where a dryer is located, that is to say a container, usually made from plastic, which is filled with a dryer granulate for the dehydration of refrigerant. After the refrigerant has flowed around or through the dryer, it passes through a filter sieve into the lower region of the header. The sieve has the task of removing impurities in the form of very fine particles from the refrigerant. The refrigerant thereafter enters the collecting tube of the condenser again via the lower overflow orifice. In this type of construction, all the metal parts, that is to say flat tubes, ribs, collecting tubes and header, are hard-soldered in a soldering furnace, that is to say at a temperature of about 620° C. The plastic insert having the granulate does not withstand temperatures of this kind, and it is therefore inserted only after soldering into the header which is subsequently closed by means of a cover. The insert with dryer granulate can then also be exchanged for maintenance purposes.

Similar types of construction with an inserted or exchangeable dryer cartridge which is also integrated with a filter sieve as an installation part may be gathered from further publications of the Applicant, EP 0 689 041 B1 and EP 0 867 670 A2. Furthermore, condenser modules have also become known, which are only a dryer insert with granulate, that is to say without a filter sieve, that is to say the Applicant's EP 0 668 986 B1 and DE 43 19 293 C2. All these types of construction have in common the fact that the dryer insert with or without a filter sieve is mounted, that is to say positioned in the header, only after the process of soldering the condenser. After this introduction of the dryer/filter insert, the header has to be closed in a fluidtight and pressuretight manner. This requires, on the one hand, corresponding structural measures in the form of an orifice on the header with a fitting cover and, on the other hand, additional work steps after soldering for mounting the dryer insert. This, of course, entails corresponding costs which are reflected in the price of the condenser module.

The object of the present invention is to improve a refrigerant condenser of the type initially mentioned, to the effect that the mounting of the dryer/filter insert can be simplified and the production costs of the entire condenser can be reduced.

This object is achieved by means of the features of patent claim 1. In the first place, one advantage which arises is that both the dryer and the filter are mounted even before the final soldering process, so that the condenser is already complete after soldering, that is to say the dryer and the filter do not have to be mounted subsequently. A further advantage arises due to the fact that the dryer does not constitute an additional part to be mounted as a structural unit, but, instead, is integrated into the header in such a way that a portion of the header itself forms part of the dryer. This saves weight and costs. This applies, in principle, to all types of header construction according to the prior art known, for example, from DE-A 42 38 853, that is to say headers produced from tubes, tubular parts or extruded profiles.

According to an advantageous development of the invention, that portion of the header which forms the dryer and receives the dryer medium is closed off at the top and bottom by means of a perforated plate. Consequently, ingress of the refrigerant from both sides or a passage of the refrigerant through the dryer region in both directions is possible.

In a further advantageous refinement of the invention, a felt layer is arranged between the lower perforated plate and the dryer medium (granulate), thus preventing a pronounced abrasion of the granulate and suppressing a possible abrasion of the granulate.

In a further advantageous refinement of the invention, the granulate is compressed via a spring-loaded pressure plate, with the result that abrasion due to shaking movements is likewise avoided.

In a further advantageous refinement of the invention, the closing plates may be connected frictionally, positively or materially integrally to the inner wall of the header, thus allowing a firm connection either before or during the soldering process.

In a further advantageous refinement of the invention, the header is widened in its cross section in the portion between the closing plates, that is to say it forms in each case, with respect to the adjacent header regions, a step, into which the closing plates can be positioned and fastened positively or frictionally. Furthermore, owing to this cross-sectional widening, a larger quantity of granulate can be received or the height of the dryer portion can be reduced, thus increasing the efficiency of the drying operation.

In a further advantageous refinement of the invention, the upper closing plate is formed by the closure of the header, that is to say the drying portion is located in the uppermost region of the header. The dryer is consequently further simplified, since further parts and work operations are dispensed with.

According to a further advantageous refinement of the invention, the filter is located in the lower region of the header between the overflow orifices, that is to say it is separated spatially from the dryer. The refrigerant flowing through the upper overflow orifice into the header therefore flows into the filter directly, without flowing through the dryer. This reduces the pressure drop of the refrigerant which flows with its entire volume flow through the header. The drying of the refrigerant is nevertheless ensured, since the refrigerant located in the header, even in its vaporous phase, comes into sufficient contact with the dryer granulate. The filter sieve, too, can readily be positioned and fastened in the header before the soldering process, for example by means of a clamping fit. In addition to the types of connection already mentioned, adhesive bonding or soldering both of the filter insert and of the closing plates for the dryer portion is also possible.

An exemplary embodiment of the invention is illustrated in the drawing and is described in more detail below. In the drawing.

Figure 1:
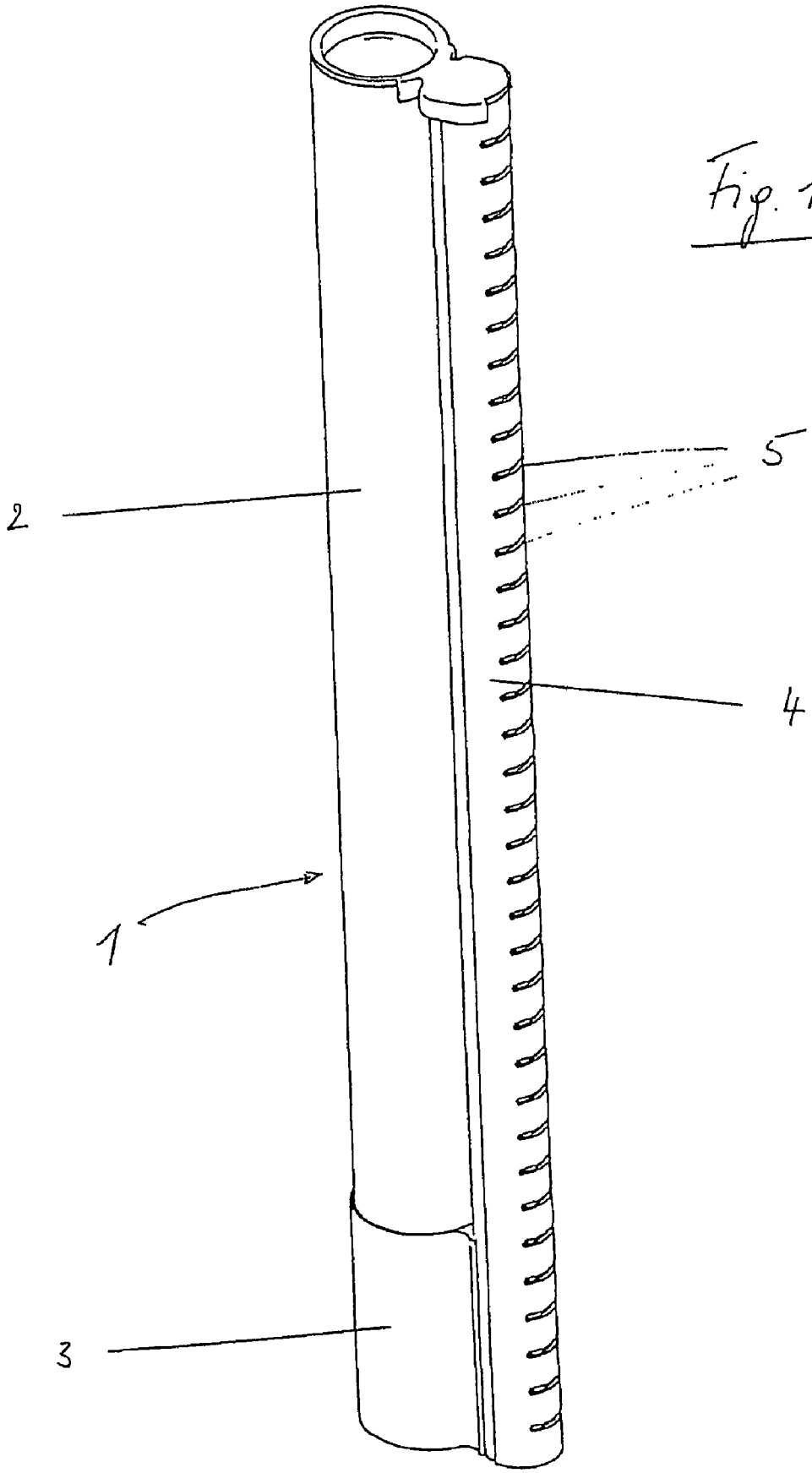
FIG. 1 shows a header/collecting tube unit.

FIG. 1 shows a header 1, consisting of a tubular portion 2 and of an extruded portion 3, and a collecting tube 4 with rim holes 5 for flat tubes, not illustrated, of a refrigerant condenser. The header 1 and collecting tube 4 form an integrated unit of a condenser module initially mentioned.

Figure 2:
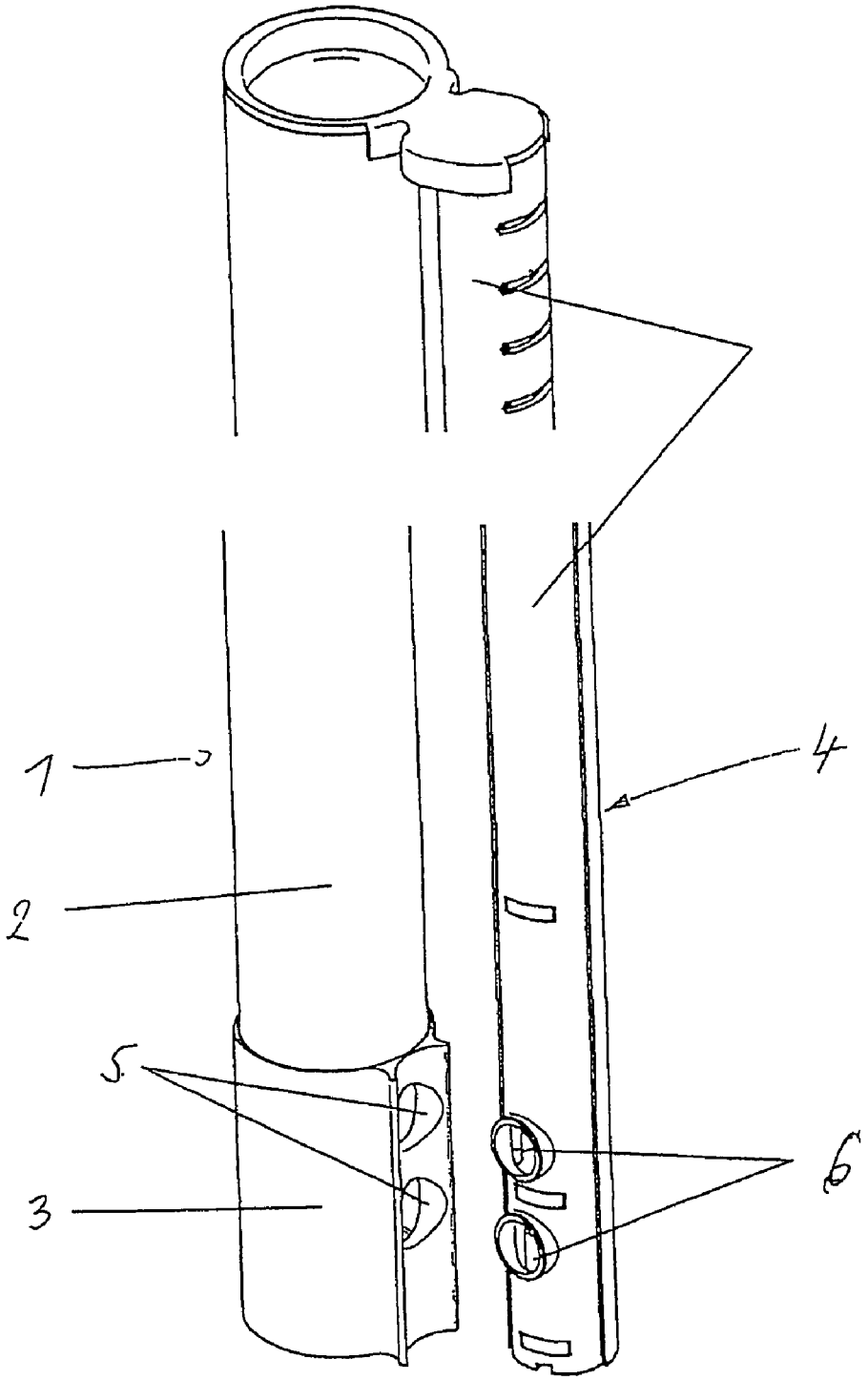
FIG. 2 shows the unit according to FIG. 1 in an exploded illustration.

FIG. 2 shows the unit according to FIG. 1 in two illustrations: the upper part shows the unit according to FIG. 1 in the assembled state; and the lower part shows the header 1 and the collecting tube 4 as separate components, that is to say before their assembly. The tubular portion 2 is inserted into the extruded portion 3 and is soldered to the latter. The extruded portion 3 has two overflow orifices 5 which are assigned two rim holes 6 on the collecting tube 4. The more particular construction and assembly of the header 1 and of the collecting tube 4 are described in more detail in the Applicant's older patent application bearing the file number 101 54 891.

Figure 3:
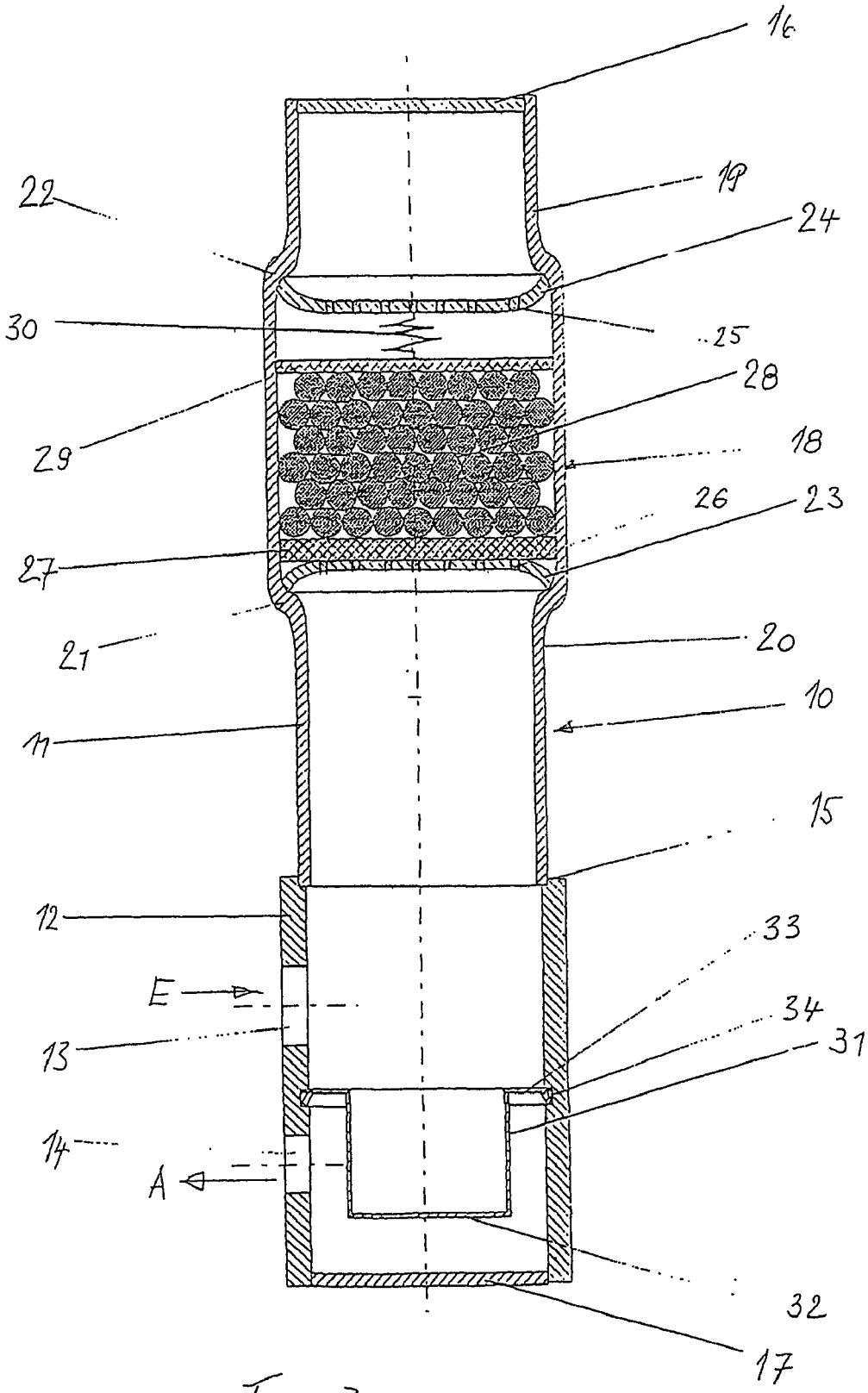
FIG. 3 shows a section through the header with dryer and filter.

FIG. 3 shows the design according to the invention of a header 10 which corresponds in its type of construction to the header 1 in conjunction with the collecting tube 4 according to FIGS. 1 and 2. The header 10 is composed of a tubular piece 11 of smaller wall thickness and an extruded tubular piece 12 of larger wall thickness. The lower tubular piece 12 has an upper overflow orifice 13, that is to say an inflow orifice, and a lower overflow orifice 14, that is to say an outflow orifice. The upper tubular piece 11 is inserted into the lower tubular piece 12 and is connected to the latter in the region of the joining point 15 by soldering. The two tubular pieces 11 and 12 are closed off in a pressuretight manner, likewise by soldering, at their ends located opposite one another, in each case by means of closing covers 16, 17. The tubular piece 11, which is produced from a welded tube, has a portion 18 of widened cross section which has adjoining it on both sides portions 19 and 20 with an equal smaller cross section. Such a cross-sectional widening can be produced by the expansion of the tube 11, for example by internal high pressure forming (IHF) or what is known as hydroforming. This cross-sectional widening in the region of the portion 18 results in steps 21 and 22 in the profile of the tube 11. In the region of these steps 21, 22 perforated disks 23 and 24, that is to say disks with passage orifices 25 and 26 which are distributed in a multiplicity over the entire cross section, are inserted into the interior of the tubular portion 18. Above the lower perforated disk 23 is arranged a felt layer 27, above which a dryer medium in the form of granulate 28 is located in a dense packing. This dryer granulate 28 is resistant to high temperature, that is to say it does not undergo any impairment during the soldering process. Above the uppermost layer of the granulate 28 is arranged a pressure plate 29 which is supported on the lower surface of the perforated plate 24 via a compression spring 30. This ensures that the packing of the granulate 28 is compressed and does not slip out of place and therefore no abrasion occurs.

The two perforated disks 23, 24 are supported, on the one hand, with their edges, in the region of the transitions 21, 22, positively and frictionally with respect to the wall of the tubular piece 11. In addition, during the final soldering process, they are soldered to the tubular piece 11, so that they form an unreleasable connection with the tube 11. Alternatively, adhesive bonding of the perforated plates 23, 24 to the tubular piece 11 may also be provided. In the lower region of the header 10, that is to say in the extruded tubular piece 12 and between the two overflow orifices 13, 14, is arranged a filter sieve 31 which is of cup-shaped design and has a bottom 32 and an annular edge region 33. The latter is inserted in an annular groove 34 in the tubular piece 12 and is anchored there. Premounting before soldering is therefore carried out by insertion of the edge 33 into the groove 34, and final firm materially integral connection takes place during the concluding process of soldering the condenser.

According to a variant, not illustrated, the filter sieve may also be of annular design.

The functions of drying, on the one hand, and of filtration, on the other hand, are separated spatially here, that is to say drying takes place in the upper region of the header 10, whereas filtration takes place in the lower region. As is known from the prior art initially mentioned, the refrigerant passes through the inflow orifice 13, following the arrow E, into the interior of the header 10, flows through the filter sieve 31 of cup-like design and leaves the header via the outflow orifice 14, following the arrow A. This results in a relatively minor pressure drop for the refrigerant which flows through the header 10, since the refrigerant does not have to flow through the dryer, as it does in the prior art. Drying takes place in that refrigerant vapor and/or refrigerant liquid which pass into the upper region of the header 10 come into contact with the dryer granulate 28 there and are thus dehumidified. In the upper region of the header 10, that is to say above the inflow orifice 13, therefore, a secondary flow of the refrigerant is formed, which leads first to the dryer granulate 28 and from there, dehumidified, flows back in the direction of the filter sieve 31. The two functions of drying and of filtration are consequently ensured.

As already mentioned above, the invention can also be implemented with other forms of header construction, for example in the case of a continuous extruded header profile.

The invention claimed is:

1. A soldered refrigerant condenser, comprising:

a heat exchanger network with flat tubes and corrugated ribs, collecting tubes which are fluid-connected to the flat tubes, and a header which is arranged parallel to one of the collecting tubes and which receives within it a dryer and/or filter and is fluid-connected to the collecting tube via overflow orifices, wherein the dryer is formed by a space which receives a dryer medium and which is delimited by a portion of the header and two closing plates passing through a cross section of the header, wherein an elastically prestressed pressure plate is arranged between an upper closing plate and the dryer medium which comprises a granulate, wherein the portion containing the dryer granulate is arranged in an upper region of the header, preferably in an upper third, in relation to a total height H of the header, and wherein the filter is arranged in a lower region of the header between two overflow orifices.

2. The condenser as claimed in claim 1, wherein at least one of the closing plates is designed as a perforated plate.

3. The condenser as claimed in claim 1, wherein the portion of the header is widened in its cross section with respect to adjacent regions.

4. The condenser as claimed in claim 3, wherein the header is designed as a tube and the widened portion is produced by expansion.

5. The condenser as claimed in claim 1, wherein a felt layer is arranged between a lower perforated plate and the dryer medium which comprises a granulate.

6. The condenser as claimed in claim 1, wherein the closing plates form a firm connection with the wall of the header.

7. The condenser as claimed in claim 6, wherein the firm connection is frictional.

8. The condenser as claimed in claim 6, wherein the firm connection is positive.

9. The condenser as claimed in claim 6, wherein the firm connection is materially integral.

10. The condenser as claimed in claim 1, wherein said closing plates comprise an upper closing plate and a lower closing plate and the upper closing plate is designed as a closure of the header.

11. The condenser as claimed in claim 1, wherein the filter is designed as a cup-shaped close-mesh sieve.

12. The condenser as claimed in claim 11, wherein the sieve has an annular edge region which is firmly connected to a wall of the header.

* * * * *